US007300573B1

(12) United States Patent
Trangsrud

(10) Patent No.: US 7,300,573 B1
(45) Date of Patent: Nov. 27, 2007

(54) CATCH BASIN FILTER

(75) Inventor: Julian P. Trangsrud, Northfield, MN (US)

(73) Assignee: Royal Concrete Pipe, Inc., Stacy, MN (US)

( * ) Notice: Subject to any disclaimer, the term of this patent is extended or adjusted under 35 U.S.C. 154(b) by 103 days.

(21) Appl. No.: 11/197,384

(22) Filed: Aug. 4, 2005

(51) Int. Cl.
*E03F 5/06* (2006.01)

(52) U.S. Cl. ..... 210/163; 210/166; 210/474; 404/4

(58) Field of Classification Search ..... 210/163, 210/164, 166, 474, 335, 339, 477; 404/4, 404/5

See application file for complete search history.

(56) References Cited

U.S. PATENT DOCUMENTS 1,195,827 A * 8/1916 Lucke ..... 210/163
1,762,838 A * 6/1930 Shand ..... 210/166
1,773,640 A * 8/1930 Prasivka ..... 210/164
1,973,321 A * 9/1934 Schultz ..... 210/163
2,666,493 A * 1/1954 Gordon ..... 210/166
3,529,723 A * 9/1970 Hagedorn ..... 210/163
4,035,297 A * 7/1977 Aldridge et al. ..... 210/163
4,525,273 A * 6/1985 Logsdon ..... 210/164
5,234,582 A * 8/1993 Savoie ..... 210/163
5,469,670 A * 11/1995 Thaler ..... 210/163
5,733,444 A 3/1998 Johnson ..... 210/163
6,004,457 A 12/1999 Singleton ..... 210/163

OTHER PUBLICATIONS

Affordable Erosion Protectors offered by Circle H Enterprises Inc. (brochure), no date.

* cited by examiner

*Primary Examiner*—Christopher Upton
(74) *Attorney, Agent, or Firm*—Steven E. Kahm; Nikolai & Mersereau, P.A.

(57) ABSTRACT

A catch basin filter having apertures and holding a silt barrier material may be securely attached to a drop inlet grate. The catch basin filter has apertures for preventing debris from entering the drop inlet and clogging sewers. A silt barrier material wrapped around the catch basin filter housing provides a study and stable platform for holding the filter in place around the drop inlet such that silt will not be able to enter the sewer and clog it up. The catch basin filter is quickly and easily attached to and removed from the drop inlet by a rod having a hook for extending through the grate bars and then turning the rod to engage the bars on the drop inlet grate to hold the catch basin filter in place. The catch basin filter is durable and reusable and the silt filter material may be easily replaced.

17 Claims, 6 Drawing Sheets

CATCH BASIN FILTER

BACKGROUND OF THE INVENTION

1. Field of the Invention

This invention relates to traps and filters for attachment over the gratings on sanitary, storm or catch basin inlet drops.

2. Description of the Related Art

When streets are under construction, the catch basins for the sewers can fill up with all kinds of debris during rains. When construction in the area is not complete there are many objects in the area that can be washed into the newly installed sewer and clog it up, whereas after construction when the area is in finished condition, landscaped, fully paved, and construction related debris is removed there are fewer objects which can be washed into the catch basin and clog up the sewer.

In the past, bales of hay would be placed in the water flow path to an inlet drop to filter out debris; however silt and other smaller particles would go around or through the bales and clog the sewer as would some of the hay. The bales were subject to moving, not being placed properly to block all of the flows, being eaten by deer, rabbits or other animals or posing a hazard as rats, mice or other pests used the hay bales for nests. Further, the bales could easily come apart and loose their effectiveness as debris flow barriers.

Other attempts to keep debris and silt out of sewers were by use of silt fences. A silt barrier material staked across a flow path was supposed to stop silt and debris from entering an inlet drop into a sewer. Such debris fences had limited success as water flows carrying debris could undermine the fence, go around the fence or destroy the fence.

One solution was to place a slotted barrel like member over the inlet drop and wrap it with a silt screen material to let water through but keep silt and debris out. However the barrel was not secured to the inlet drop and could easily be removed from its protective position thus letting silt and debris into the sewer.

Another solution was to provide a silt barrier material around the inlet drop to prevent water and debris from entering the sewer and stake the silt barrier material in place. However the staked out sheeting would not remain in place when the pressure of large amounts of water where present. To help hold the sheeting in place a cylindrical framework like a bicycled wheel at the top and bottom of a sheet was used to support a sheet of plastic and a central axis rod holding the wheel would be used to separate the wheels and attach the rod to the grate over the inlet drop. However it was difficult to set up the sheet around the barrier to keep the water out of the inlet drop as there was not a good seal of the silt barrier material to the frame, and the silt barrier material was subject to tearing, holes being poked through and other damage due to lack of support.

It is desired to have a debris and silt barrier that allows water therethrough into an inlet drop while being strongly secured to the grating over the inlet drop and having apertures for allowing water through while preventing debris through and supporting a silt guard to prevent silt from entering the sewer. The barrier should be easy to install and durable enough to withstand torrents of water with debris therein. The barrier should also completely cover the inlet drop to prevent accidents where people trip or fall on the inlet drop. The barriers are also used for clearly marking the position of the inlet drops.

SUMMARY OF THE INVENTION

A catch basin filter is attached to a drop inlet to secure the catch basin filter in place so it cannot be removed from over the drop inlet. The catch basin filter will be in place when a flow of water occurs thus filtering out silt and debris from the water before it enters the sewer though the drop inlet. The catch basin filter is temporally attached to the drop inlet grate during construction. The catch basin filter is quickly and easily attached to the grate of the drop inlet by a rod having a J-shaped hook at the end, which extends through the drop inlet grate and is then turned and pulled upward to engage the grate so it cannot be further pulled upward securing the catch basin to the grate. The base of the catch basin filter thus securely surrounds the rim of the drop inlet and prevents water from entering the drop inlet. The catch basin filter has apertures in its wall for allowing water through while preventing debris from passing through the apertures. The catch basin filter may also have silt barrier material surrounding it to prevent silt and other small particles or debris from passing through the catch basin filter and thus entering and clogging up the sewer.

The catch basin filter can be quickly and easily attached to the drop inlet grate during construction and easily removed after construction and saved for use at other construction sites.

A large aperture near the top of the catch basin filter is available to admit large volumes of water during large flow events and in cases where the smaller apertures and or the silt screen becomes clogged such that the drop inlet can drain water from the area even if the bottom portion of the catch basin filter becomes clogged.

The catch basin filter is made of a durable material such as a plastic which can support a silt barrier material such that the silt barrier material will not be moved will not allow silt to enter into the drop inlet. The silt barrier material fits over the outside of the catch basin filter so that it is easy to install and replace in case it becomes clogged.

OBJECTS OF THE INVENTION

It is an object of the invention to securely affix a catch basin filter to a catch basin drop inlet.

It is an object of the invention to quickly and easily install and remove a catch basin filter to a catch basin drop inlet to provide a temporary debris and silt barrier.

It is an object of the invention to prevent debris and silt from entering a sewer though an inlet drop while allowing water to be drained through a sewer.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
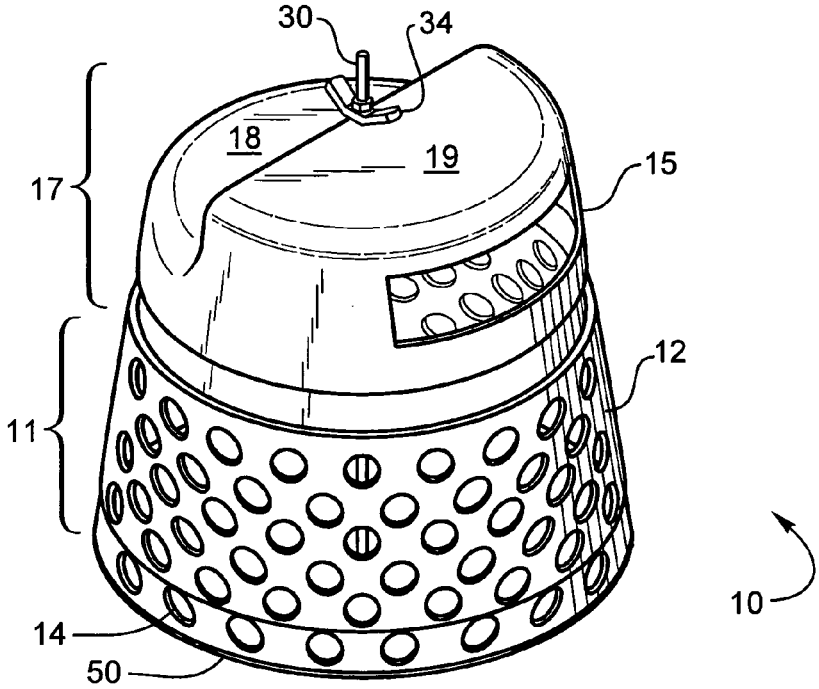
FIG. 1 is a top front perspective view of the catch basin filter.
Figure 2:
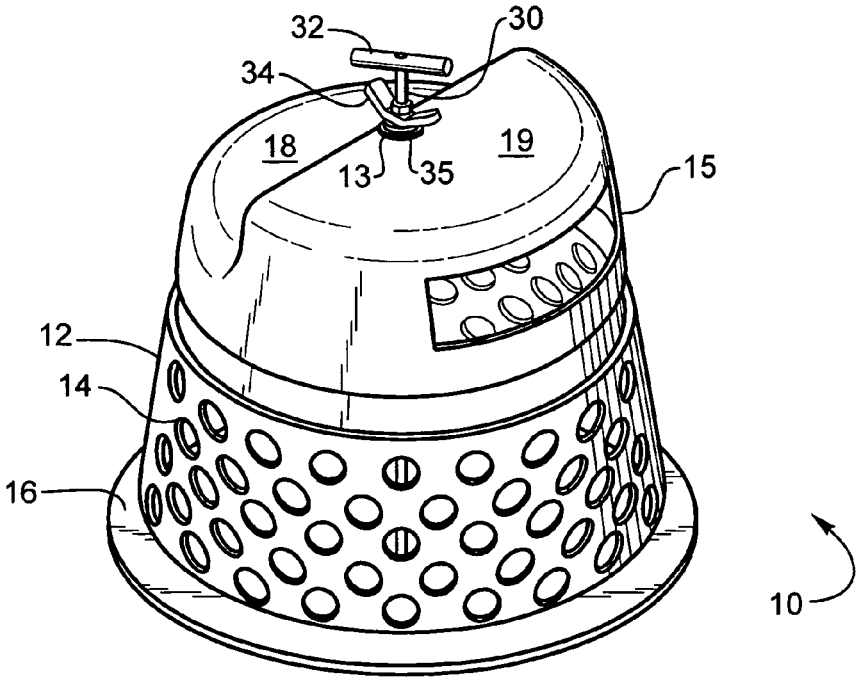
FIG. 2 is a top front perspective view of the catch basin filter with a rim and a handle on the rod.
Figure 3:
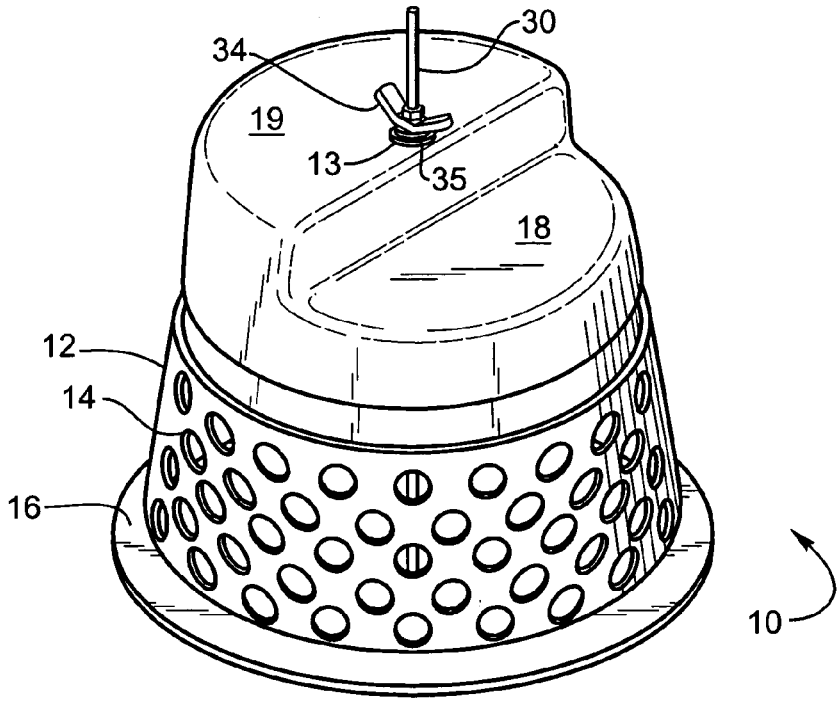
FIG. 3 is a top rear perspective view of the catch basin filter with a rim at the base.
Figure 6:
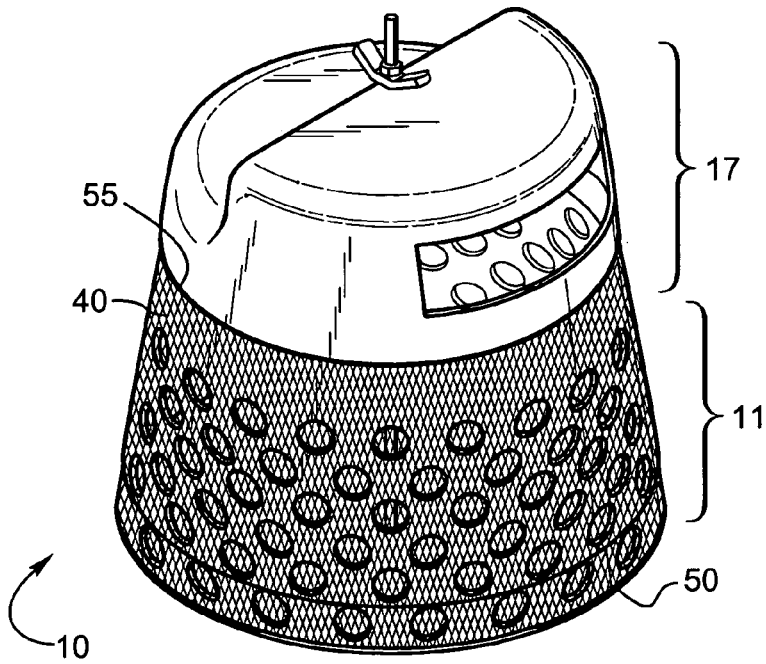
FIG. 6 is a top front perspective view of the catch basin filter with the silt barrier material placed thereon.
Figure 4:
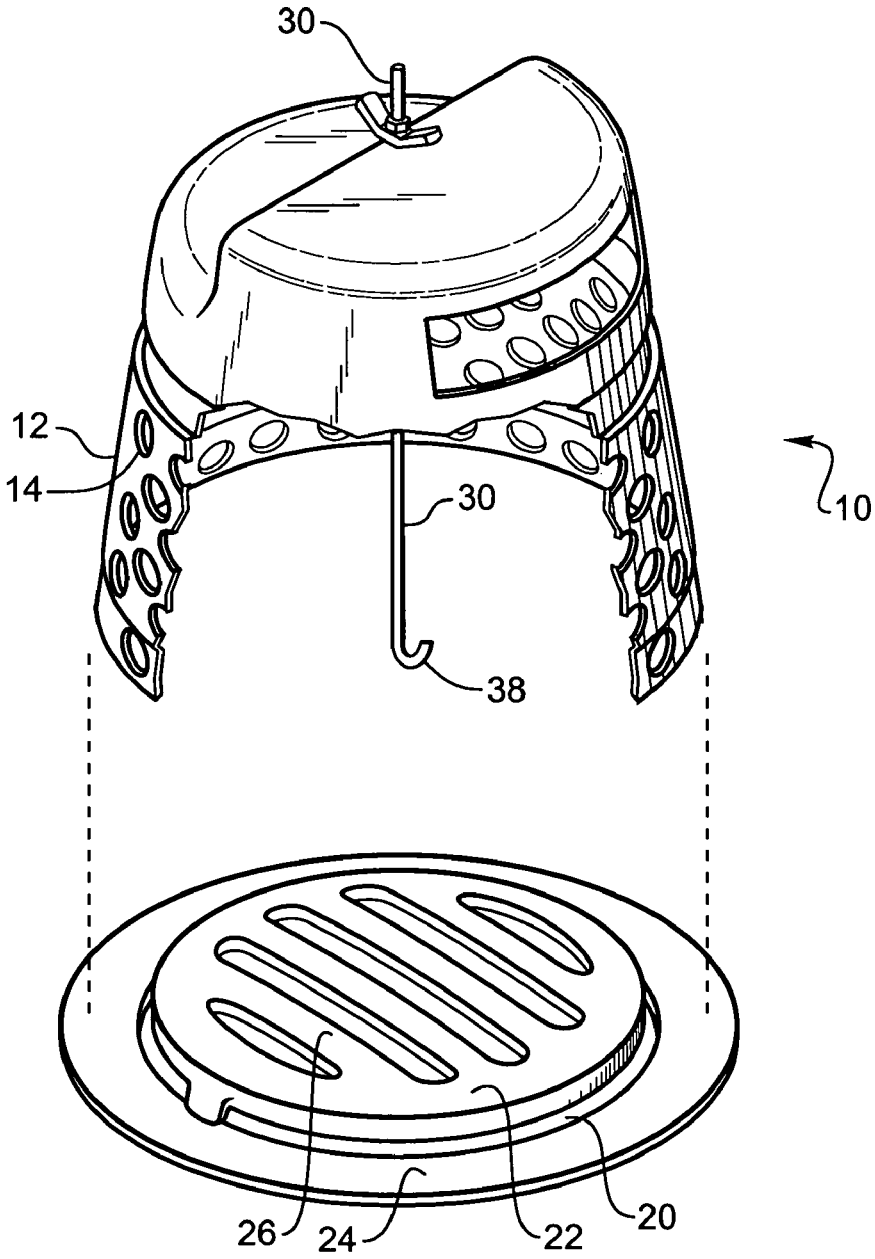
FIG. 4 is a cut-a-way perspective view of a catch basin filter showing the bottom portion of the rod over the drop inlet grate.
Figure 5:
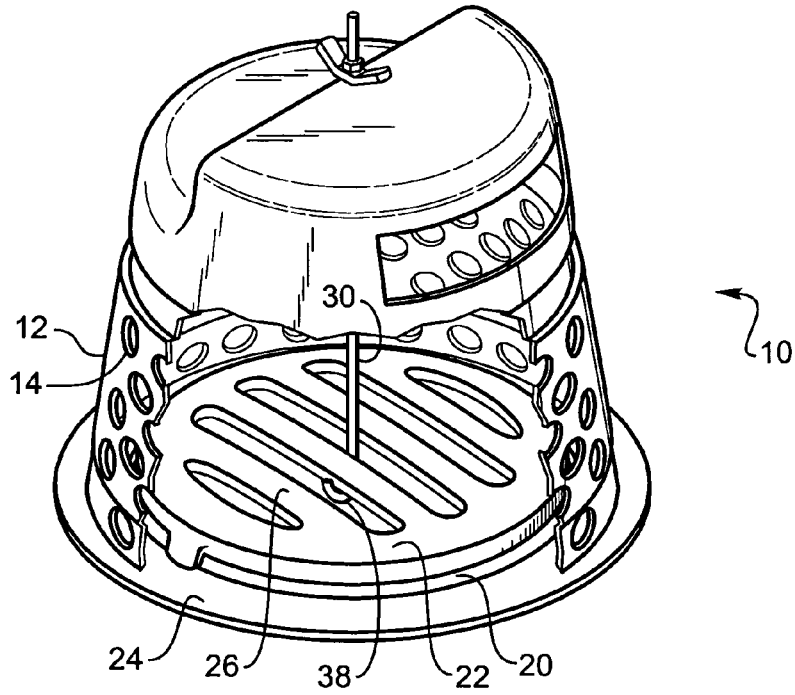
FIG. 5 is a cut-a-way perspective view of the drop inlet grate with the catch basin filter rod in the locked position on the grate.

The catch basin filter 10 has a sloped circular outer wall 12 having a larger diameter at the base than at the top. The catch basin filters 10 can then be stacked with one nested in another. The base of the catch basin filter 10 may have a rim 16 for engaging the ground or the rim 24 of a drop inlet 20. Alternatively the base of the catch basin filter 10 may have a bottom edge 50 without a rim 16.

The catch basin filter 10 has a bottom portion 11 with a plurality of apertures 14 in wall 12 for allowing water to enter the catch basin filter 10 while keeping large pieces of debris, which will not fit through the apertures 14 out. In this configuration smaller pieces of debris and silt may enter the catch basin filter 10, therefore a silt barrier material 40 is placed on the outside of the bottom portion 11 of catch basin filter 10 to keep out smaller pieces of debris, silt and other small particles and objects. The silt barrier material 40 can be form fitted to the catch basin filter 10 for ease of placing the silt barrier material 40 onto the catch basin filter 10. There may be hooks, elastic bands 55, or other means for securing the silt barrier material 40 to the catch basin filter 10. The silt barrier material 40 may be quickly and easily removed and replaced with a clean silt barrier material 40 should it become clogged with silt and need replacement.

The base of the catch basin filter 10 is open ended for water entering the catch basin filter 10 through apertures 14 in wall 12 to pass through into a drop inlet 20 so as to drain into a sewer.

In the embodiment shown, the top portion 17 of the catch basin filter 10 has a first roof portion 18 and a second roof portion 19. The second roof portion 19 is higher than the first roof portion 18. In this embodiment a safety light (not shown) may be attached to the second roof portion 19 and fold down on the first roof portion 18 when not in use. In other embodiments the roof may be entirely flat.

A threaded rod 30 passes through an aperture 13 in the second roof portion 19. Rod 30 has a wing nut 34 threaded thereon to adjust the height of rod 30 relative to the top of roof second roof portion 19. Wing nut 34 engages a washer 35 on the top of second roof portion 19 and turns on it while adjusting the position of rod 30 when turning wing nut 34. The bottom of rod 30 has a J-shaped hook 38 for passing between the grate bars 26 on drop inlet grate 22.

After J-shaped hook 38 passes between grate bars 26, rod 30 may be turned 90 degrees and the wing nut 34 tightened to draw the J-shaped hook 38 up to the base of a grate bar 26 thus tightening the catch basin filter 10 on the drop inlet grate 22. This secures the catch basin filter 10 such that it can't be removed from the drop inlet 20 and prevents rushing water and debris from dislodging the catch basin filter 10 while keeping silt and debris out of the sewer.

If the apertures 14 in the bottom portion of the catch basin filter 10 become plugged with debris and or the silt barrier material 40 becomes clogged with silt, water may build up to the top portion 17 of catch basin filter 10 and drain out into the drop inlet 20 by entering the catch basin filter 10 though overflow aperture 15. By being on the top portion 17 of catch basin filter 10 less silt and debris will be let through into the sewer helping to keep the sewer clean while draining the area during high water flow events.

Rod 30 may alternatively have a handle 32 at the top to help lift or turn rod 30. The handle 32 may be aligned with the grate engaging J-shaped hook 38 to help in placing the J-shaped hook 38 between the grate bars 26 and then turning the grate engaging J-shaped hook 38 perpendicular to the grate bars 26 for hooking them.

Figure 8:
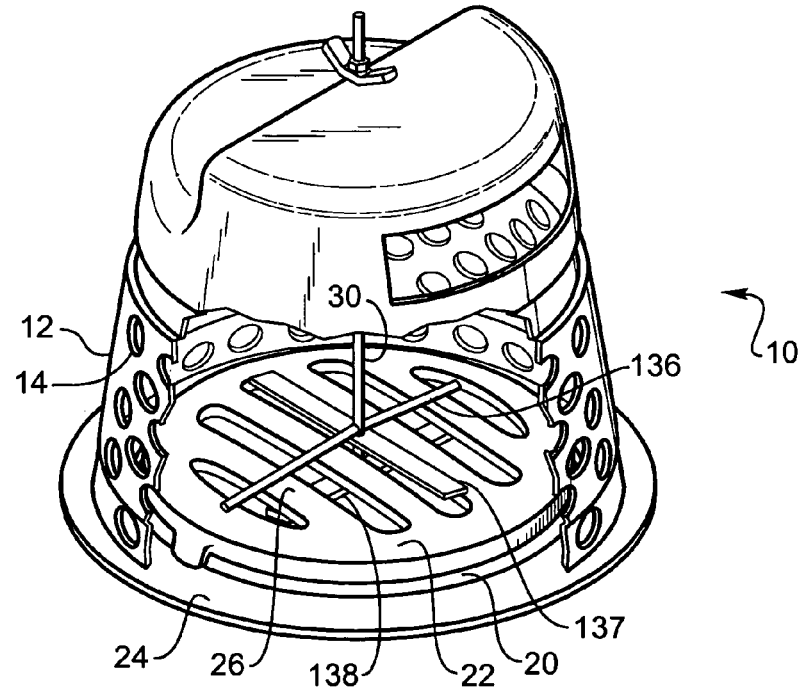
FIG. 8 is a cut-a-way perspective view of the drop inlet grate with the catch basin filter bottom bar in the locked position on the grate.
Figure 7:
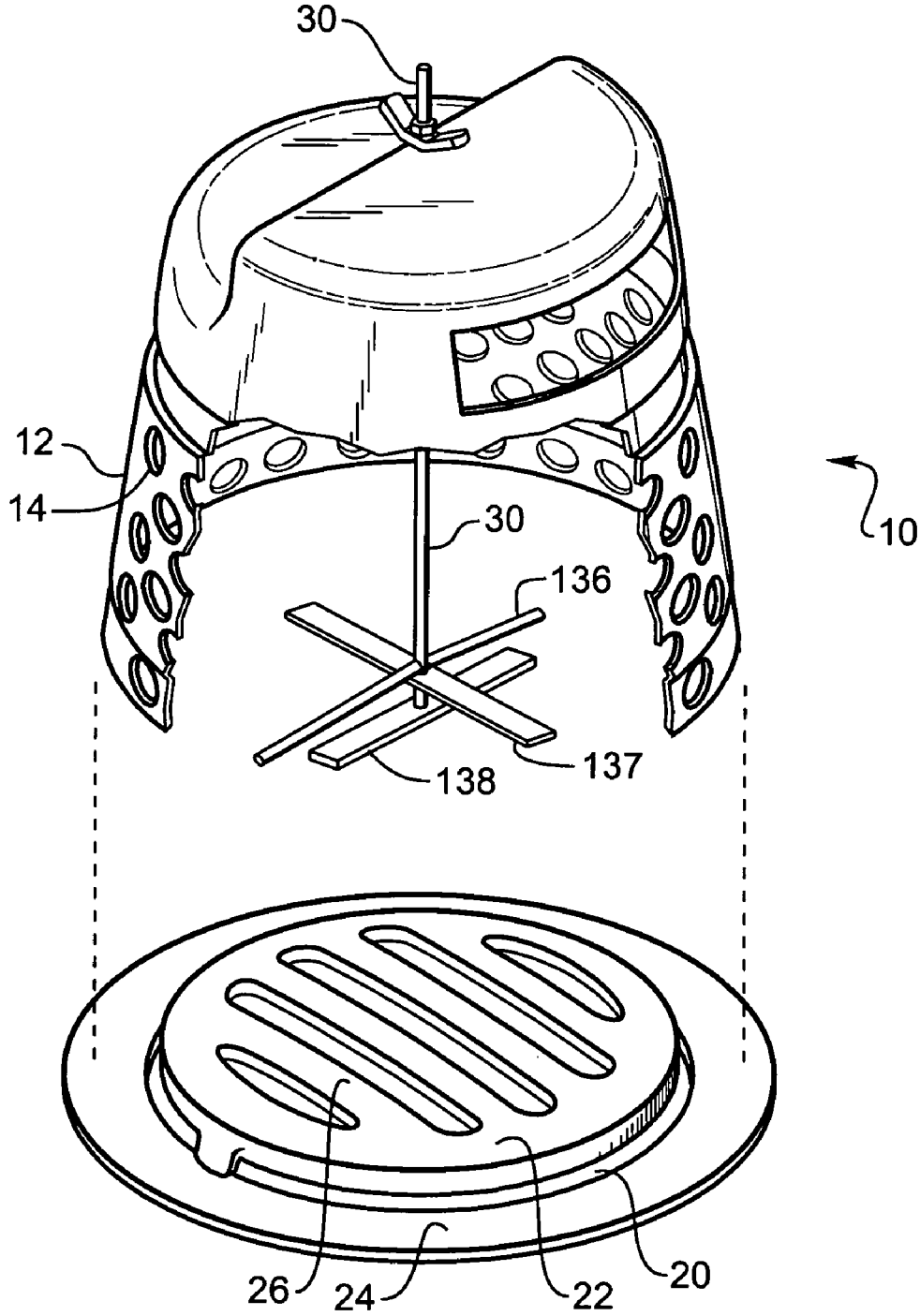
FIG. 7 is a cut-a-way perspective view of a catch basin filter showing the bottom bar of the rod over the drop inlet grate.
Figure 9:
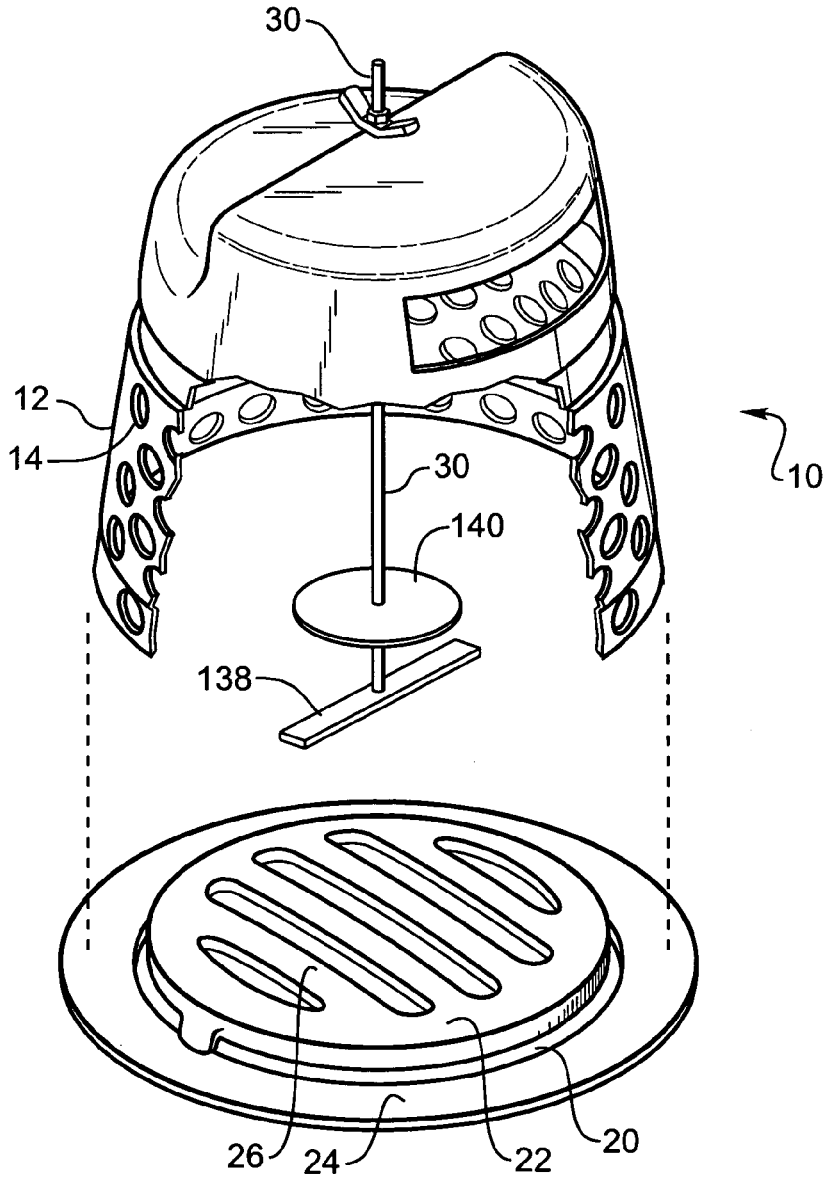
FIG. 9 is a cut-a-way perspective view of a catch basin filter showing the bottom bar of the rod over the drop inlet grate and a disk as a rod stop on the grate.

In an alternative embodiment as shown in FIGS. 7 and 8 the inlet grate 22 may be engaged by a bottom bar 138 on rod 30 which passes between grate bars 26. After bottom bar 138 passes through grate 22 a perpendicular bar 137 on rod 30 stops rod 30 from descending through grate bars 26. A bar 136 parallel to bottom bar 138 is attached to rod 30 at approximately the same height as perpendicular bar 137 so that no matter how the rod 30 is turned after bottom bar 38 passes between grate bars 26 rod 30 will not be able to descend further into drop inlet 20. In another embodiment bars 136 and 137 may be replaced by disk 140 as shown in FIG. 9. Other means for engaging the grate are also possible including but limited to L shaped or T shaped hooks on the end of the rod are possible.

Obviously, many modifications and variations of the present invention are possible in light of the above teachings. It is therefore to be understood that, within the scope of the appended claims, the invention may be practiced otherwise than as specifically described.

What is claimed is:

1. A catch basin filter comprising:

a generally cylindrical housing having a substantially vertically oriented circular wall with a bottom portion and a top portion, the bottom portion having a plurality of debris blocking apertures for admitting water but blocking debris from passing therethrough, the top portion having at least one overflow aperture for allowing water and debris to pass through, the base of the cylindrical housing having an aperture for surrounding a catch basin, a roof on the housing, said roof being substantially solid except for an aperture for extending a threaded rod therethrough, the threaded rod having a wing nut engaging the threaded rod and the roof of the housing for adjusting the length of the rod in the housing, a means for engaging a catch basin grate bar on the end of the threaded rod.

2. A catch basin filter as in claim 1 wherein, the bottom of the circular wall has a rim running around the circumference of the catch basin filter.

3. A catch basin filter as in claim 1 wherein, a handle at the top of the rod aids in rotating the rod to align the hook on the rod relative to the catch basin grate.

4. A catch basin filter as in claim 1 wherein, a silt barrier material is wrapped around the bottom portion of the housing to block silt from passing though the apertures.

5. A catch basin filter as in claim 4 wherein, the bottom of the circular wall has a rim running around the circumference of the catch basin filter.

6. A catch basin filter as in claim 5 wherein, the wall is slanted inward toward the axis of the catch basin filter as the height increases from the base to the roof.

7. A catch basin filter as in claim 6 wherein, a handle at the top of the rod aids in rotating the rod to align the hook relative to the catch basin grate.

8. A catch basin filter as in claim 4 wherein, the wall is slanted inward toward the axis of the catch basin filter as the height increases from the base to the roof.

9. A catch basin filter as in claim 8 wherein, a handle at the top of the rod aids in rotating the rod to align the hook relative to the catch basin grate.

10. A catch basin filter as in claim 9 wherein, the roof of the catch basin filter has a first portion at a first height and a second portion at a second height.

11. A catch basin filter as in claim 8 wherein, the roof of the catch basin filter has a first portion at a first height and a second portion at a second height.

12. A catch basin filter as in claim 1 wherein, the wall is slanted inward toward the axis of the catch basin filter as the height increases from the base to the roof.

13. A catch basin filter as in claim 1 wherein, the roof of the catch basin filter has a first portion at a first height and a second portion at a second height.

14. A catch basin filter as in claim 1 wherein, a J-shaped hook on the end of the rod is the means for engaging the grate.

15. A catch basin filter as in claim 14 wherein, a bar at the end of the rod for inserting between the grate bars when parallel to the opening.

16. A catch basin filter as in claim 15 wherein, second and third bars on the rod prevent the rod from descending through the grate bars.

17. A catch basin filter as in claim 14 wherein, a disk on the rod above the bar to engage the grate bars and stop the rod from descending.

* * * * *